US009382796B2

(12) United States Patent
Kim

(10) Patent No.: US 9,382,796 B2
(45) Date of Patent: Jul. 5, 2016

(54) CARTRIDGE FOR TUNNEL BLASTING

(71) Applicant: Korea Railroad Research Institute, Gyeonggi-do (KR)

(72) Inventor: Dong Hyeon Kim, Seoul (KR)

(73) Assignee: KOREA RAILROAD RESEARCH INSTITUTE, Gyeonggi-Do (KR)

( * ) Notice: Subject to any disclaimer, the term of this patent is extended or adjusted under 35 U.S.C. 154(b) by 7 days.

(21) Appl. No.: 14/497,561

(22) Filed: Sep. 26, 2014

(65) Prior Publication Data

US 2015/0102652 A1 Apr. 16, 2015

(30) Foreign Application Priority Data

Oct. 14, 2013 (KR) ..... 10-2013-0121678

(51) Int. Cl.
*E21C 37/00* (2006.01)
*E21C 37/06* (2006.01)
*E21C 37/08* (2006.01)

(52) U.S. Cl.
CPC ..... *E21C 37/06* (2013.01); *E21C 37/08* (2013.01)

(58) Field of Classification Search
CPC ..... E21C 37/08; E21C 37/02
See application file for complete search history.

(56) References Cited

U.S. PATENT DOCUMENTS 2,145,473 A * 1/1939 Billner ..... E21C 37/00 125/1
4,074,629 A * 2/1978 Colgate ..... F42D 1/00 102/313
4,790,602 A * 12/1988 Pocci ..... E21C 37/08 299/21
4,865,391 A * 9/1989 Chevakin ..... E21C 37/02 299/23

FOREIGN PATENT DOCUMENTS

| | | | | |
|---|---|---|---|---|
| CN | 1060334 A | 4/1992 | | |
| CN | 202866879 U | 4/2013 | | |
| CN | 103726819 A | 4/2014 | | |
| FR | 2255574 A1 * | 7/1975 | ..... | F42D 1/00 |
| JP | 05-118188 A | 5/1993 | | |
| KR | 20-0215836 Y1 | 3/2001 | | |
| KR | 10-0614795 B1 | 8/2006 | | |
| RU | 2026989 C1 * | 1/1995 | | |

OTHER PUBLICATIONS

Chinese Office action for 2014105365651 dated Dec. 3, 2015.

* cited by examiner

*Primary Examiner* — John Kreck
(74) *Attorney, Agent, or Firm* — Pearne & Gordon LLP

(57) ABSTRACT

A cartridge for tunnel blasting is provided a cartridge for tunnel blasting, which easily breaks a rock, by inserting a cartridge containing water into a bore hole formed in a rock by using a boring device, and injecting liquid nitrogen into the inserted cartridge, so as to induce cracks of the rock by using the characteristic of the water that expands when it is frozen.

7 Claims, 5 Drawing Sheets

CARTRIDGE FOR TUNNEL BLASTING

CROSS-REFERENCE TO RELATED APPLICATION

This application claims the benefit of Korean Patent Application No. 10-2013-0121678 filed on Oct. 14, 2013, the disclosures of which are incorporated herein by reference.

TECHNICAL FIELD

The embodiments described herein pertain generally to a cartridge for tunnel blasting, in particular, a cartridge for tunnel blasting, which injects a cartridge containing water into a bore hole to be formed in a rock, and rapidly cooling the water injected into the cartridge, whereby the rock can be easily broken by using the characteristic of water that expands when it is frozen.

BACKGROUND

In recent, the necessity to expand social infrastructures is increasing. Thus, it is necessary to develop downtown areas or populated civilian areas. However, there are frequent occasions where rocks in various forms, etc., are protruded to be obstructive factors of civil works such as construction of roads or tunnels to be established in the areas during the works.

Accordingly, when developing populated civilian areas, precise electronic areas, cultural property areas, and so on, a rock breaking technique is currently and restrictively being used. However, the rock breaking technique has caused productivity reduction, indirect civil complaints, air delay and cost maximization.

Specifically, when a large rock is found out during civil works, a gunpowder blasting method, and a shearing method using a breaker, etc., have been conventionally used to cut the rock. The gunpowder blasting method forms multiple insertion holes on a rock by using a crawler drill or the like, and inserts gunpowder into the insertion holes to blast the gunpowder. In addition, the shearing method using a breaker breaks a rock by continuously hitting part of the rock with a separate breaker.

However, the above-described gunpowder blasting method causes the problem of ground shaking due to explosion and pressure upon the blasting, and when the blasting is conducted in an area surrounded by buildings such as houses, it causes problems resulting in significant damages such as occurrence of cracks in the surrounding buildings.

Further, in case of the shearing method using a breaker, noise and vibration generated when the breaker continuously hits a rock are transferred even to the outside, and thereby, causing serious damages to the peripheries.

Accordingly, in order to solve the problems, there has been developed the technology described in Korean Patent No. 10-0614795. The technology is characterized by including a cooling pipe that is longitudinally inserted into each of a multiple number of holes, which are bored in a rock to contain water, to rapidly freeze peripheral water within the holes, a coolant supplier that injects and supplies a liquid coolant for rapid freezing of the cooling pipe and its peripheral water into the cooling pipe, and a vacuum absorber that absorbs air within the cooling pipe to make the inside of the cooling pipe in the negative pressure state for easy injection of the coolant into the cooling pipe, and collects the vaporized coolant in the cooling pipe, wherein the liquid coolant is injected into the cooling pipe to rapidly freeze the peripheral water of the cooling pipe such that the peripheral rock of the holes is broken by the expansion force generated when the water is cooled and frozen.

With respect to other technical features of the technology, the cooling pipe has a cylindrical structure with its interior space being sealed, wherein in an upper portion of the interior space, there is provided a blocking wall that partitions an upper chamber and a lower chamber, and an injection pipe for injection of a coolant from the outside and an absorption pipe for discharge of interior air and a vaporized coolant penetrate through the top end surface of the cooling pipe to be longitudinally inserted into the upper chamber and the lower chamber, whereby first cooling through the upper chamber and second cooling through the lower chamber can be performed by stages.

Although the technology described in Korean Patent No. 10-0614795 is advantageous in that it can easily break a rock without causing noise and vibration, it is cumbersome since when forming holes in a rock, the holes should have the same size as that of the cooling pipe, and problematic since when the sizes are different, the expansion force is not stably applied to the inner circumference surfaces of the holes formed in the rock.

SUMMARY

In view of the foregoing problems, example embodiments provide a cartridge for tunnel blasting, which easily breaks a rock, by inserting a cartridge containing water into a bore hole formed in a rock by using a boring device, and injecting liquid nitrogen into the inserted cartridge, so as to induce cracks of the rock by using the characteristic of the water that expands when it is frozen.

Also, example embodiments provide a cartridge for tunnel blasting, in which a cartridge inserted into a bore hole formed in a rock is formed to have an inner tube and an outer tube, and pin members are provided on the surface of the inner tube with certain intervals so as to easily transfer the expansion force of the water contained in the inner tube to the inner circumference surface of the bore hole.

Also, example embodiments provide a cartridge for tunneling blasting, in which a wedge device for hinge connection of ends of bar-shaped first and second operating bars is inserted into a bore hole formed in a rock, and a cartridge is provided in the internal side of the wedge device, such that the expansion force generated when the water contained in the cartridge is frozen is stably applied to the whole bore hole by the first and second operating bars forming the wedge device, and thus, the rock can be more easily broken.

Also, example embodiments provide a cartridge for tunnel blasting, which includes an irradiation device that irradiates a certain frequency to the water contained in the cartridge, to excitate the water and facilitate heat conduction, such that the water is more quickly changed into ice through a chill of the liquid nitrogen.

Also, example embodiments provide a cartridge for tunnel blasting, which includes a motor and a stirrer spinning by the motor in a cap sealing ends of the inner and outer tubes forming the cartridge, such that the water contained in the inner tube is stirred and quickly changed into ice.

Also, example embodiments provide a cartridge for tunnel blasting, which includes a sensor that receives an ultrasonic wave reflected on an ultrasonic wave device irradiating an ultrasonic wave to the water contained in the cartridge, to measure an ice thickness of the water contained in the cartridge, and stop the operation of the stirrer before the water is completely frozen, so that damage to the stirrer can be prevented.

In order to solve the above-described problems, example embodiments are characterized by inserting a cartridge containing water into a bore hole formed in a rock, and injecting liquid nitrogen into the cartridge to freeze the water.

Here, the cartridge includes an inner tube containing water; an outer tube provided on an external side of the inner tube; a cap sealing ends of the inner and outer tubes; a nitrogen injection line provided to penetrate through the cap and inject liquid nitrogen into a space formed between the inner and outer tubes; and a nitrogen discharge line provided to penetrate through the cap and discharge nitrogen in the space formed between the inner and outer tubes.

In addition, example embodiments are characterized in that pin members are provided on the outer circumference surface of the inner tube.

In addition, example embodiments are characterized in that a wedge device is inserted into the bore hole, and the cartridge is provided in the internal side of the wedge device.

In addition, example embodiments are characterized in that the wedge device includes first and second operating bars, of which one side ends are connected to each other by a hinge, and a guide bar of which both sides are provided with a guide hole into which the other ends of the first and second operating bars are inserted.

Here, one side of the guide bar is provided with a pressurizing member that pressurizes the cartridge.

In addition, example embodiments are characterized in that the first and second operating bars are provided with a fixing member that prevents deviation of the guide bar.

Meanwhile, example embodiments are characterized in that a stirrer is further included in the internal side of the cap to be positioned in the internal side of the inner tube, and a motor that spins the stirrer is provided in the external side of the cap.

In this case, a sponge containing water therein is further provided in the external side of the cartridge.

In addition, example embodiments are characterized in that an irradiation device for irradiating an ultrasonic wave or microwave having a certain frequency is further provided on the external side of the cartridge, and the irradiation device excitates the water contained in the cartridge.

In addition, the irradiation device further includes a sensor sensing a reflected wave.

In accordance with the above-described example embodiments, a bore hole is formed in a rock by using a boring device, a cartridge containing water is inserted into the bore hole, and liquid nitrogen is injected into the inserted cartridge, whereby a crack of the rock can be induced by using the characteristic of the water that expands when it is frozen, so that the rock can be easily broken.

In addition, in accordance with the above-described example embodiments, the cartridge to be inserted into a bore hole formed in a rock is formed to have an inner tube and an outer tube, and pin members are provided on the surface of the inner tube with certain intervals, such that an expansion force of water contained in the inner tube can be easily transferred to the inner circumference surface of the bore hole.

In addition, in accordance with the above-described example embodiments, a wedge device for hinge connection of ends of bar-shaped first and second operating bars is inserted into a bore hole formed in a rock, and the cartridge is provided in the internal side of the wedge device, such that an expansion force generated when the water contained in the cartridge is frozen is stably applied to the whole bore hole by the first and second operating bars forming the wedge device so that the rock can be easily broken.

In addition, the above-described example embodiments include an irradiation device for irradiating a certain frequency to the water contained in the cartridge, to excitate the water and facilitate heat conduction, such that the water is more quickly changed into ice through a chill of the liquid nitrogen.

In addition, the above-described example embodiments include a motor and a stirrer spinning by the motor in a cap sealing ends of the inner and outer tubes forming the cartridge, such that the water contained in the inner tube is stirred and quickly changed into ice.

In addition, the example embodiments include a sensor receiving an ultrasonic wave reflected on an ultrasonic wave device irradiating an ultrasonic wave to the water contained in the cartridge, to measure an ice thickness of the water contained in the cartridge and stop the operation of the stirrer before the water is completely frozen, so that damage to the stirrer can be prevented.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

In the detailed description that follows, embodiments are described as illustrations only since various changes and modifications will become apparent to those skilled in the art from the following detailed description. The use of the same reference numbers in different figures indicates similar or identical items.

DETAILED DESCRIPTION

Figure 1:
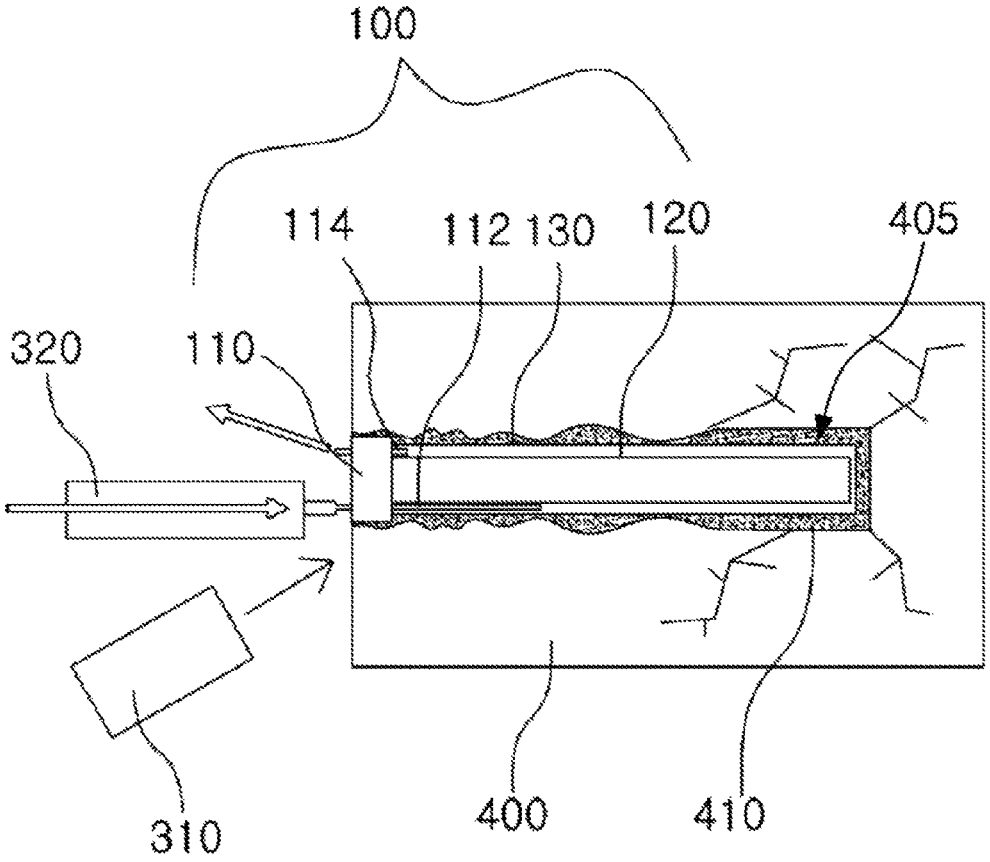
FIG. 1 is a conceptual view of a cartridge for tunnel blasting in accordance with an example embodiment.

Hereinafter, example embodiments will be described in detail with reference to the accompanying drawings so that inventive concept may be readily implemented by those skilled in the art. However, it is to be noted that the present disclosure is not limited to the example embodiments but can be realized in various other ways. In the drawings, certain parts not directly relevant to the description are omitted to enhance the clarity of the drawings, and like reference numerals denote like parts throughout the whole document.

Figure 2A:
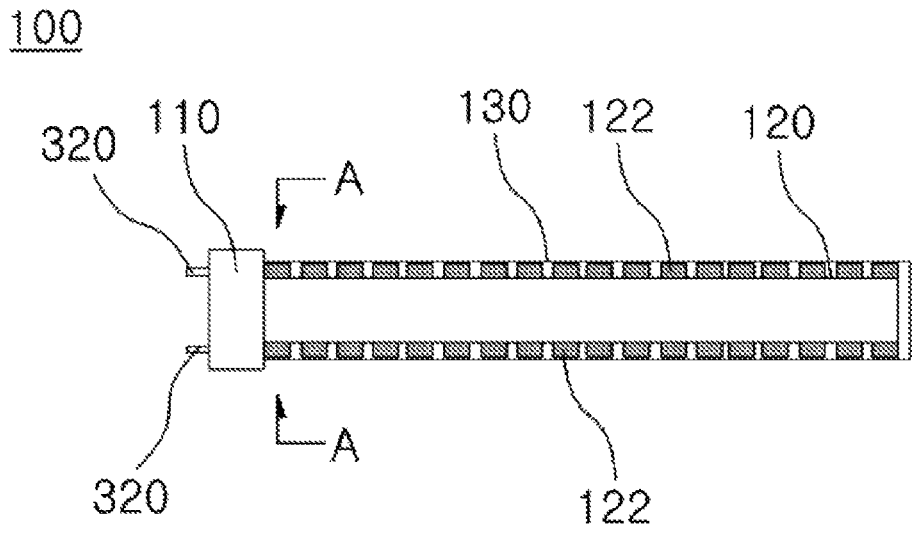
FIG. 2A is a cross-sectional view of an inner tube of a cartridge for tunnel blasting, which is provided with pin members, in accordance with an example embodiment.
Figure 2B:
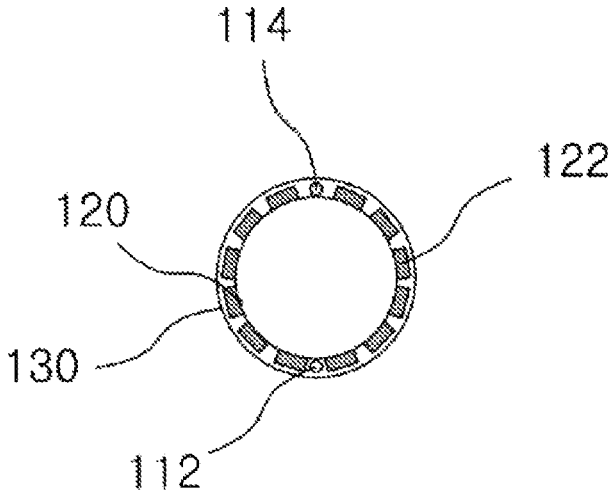
FIG. 2B is an A-A line cross-sectional view of FIG. 2A.
Figure 3:
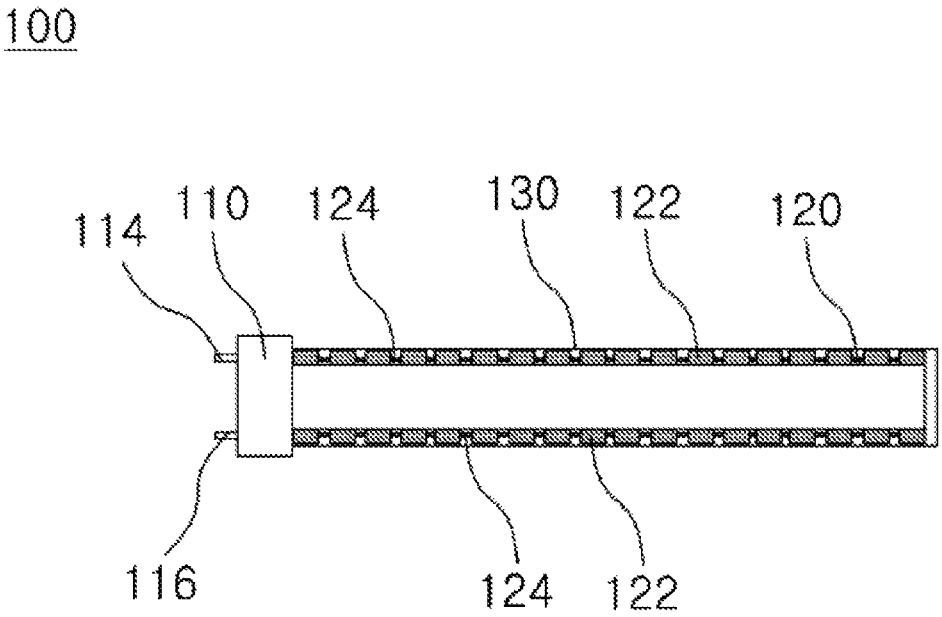
FIG. 3 is a cross-sectional view of another form of the pin members provided in the inner tube of the cartridge for tunnel blasting in accordance with an example embodiment.
Figure 4:
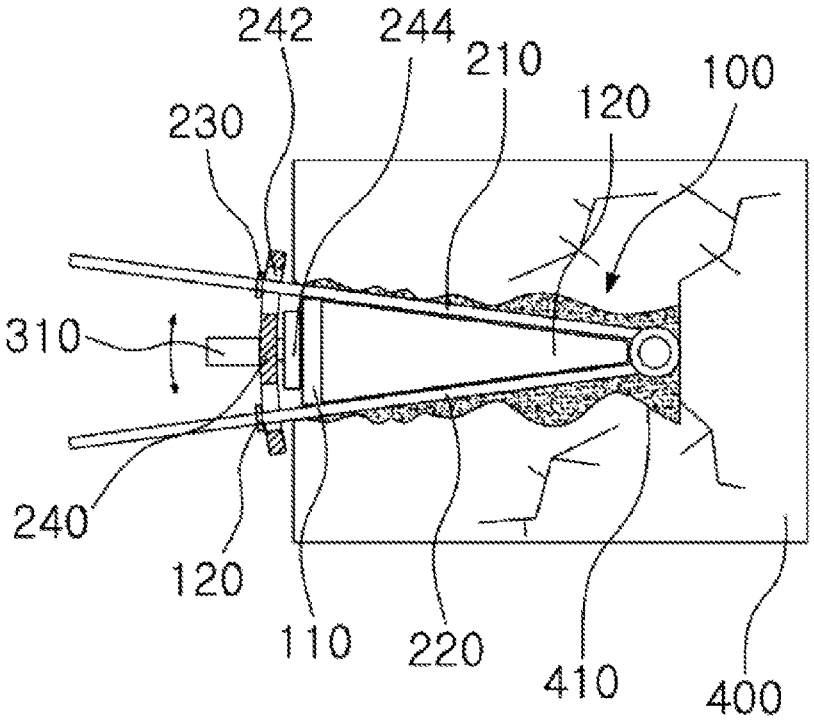
FIG. 4 is a cross-sectional view of the state that the cartridge for tunnel blasting in accordance with an example embodiment further includes a wedge device.
Figure 5:
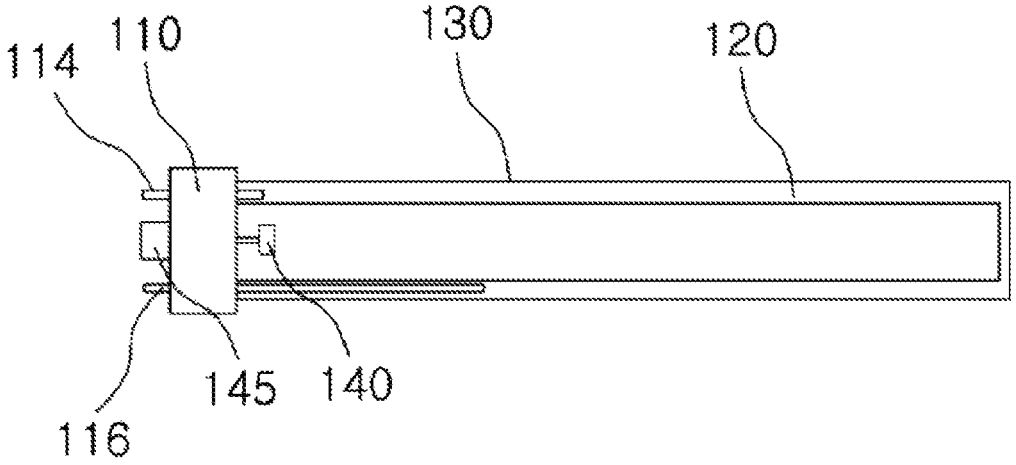
FIG. 5 is a conceptual view of the state that the cartridge for tunnel blasting in accordance with an example embodiment includes a stirrer.

FIG. 1 is a conceptual view of a cartridge for tunnel blasting in accordance with an example embodiment, FIG. 2A is a cross-sectional view of an inner tube of a cartridge for tunnel blasting, which is provided with pin members, in accordance with an example embodiment, and FIG. 2B is an A-A line cross-sectional view of FIG. 2A, FIG. 3 is a cross-sectional view of another form of the pin members provided in the inner tube of the cartridge for tunnel blasting in accordance with an example embodiment, FIG. 4 is a cross-sectional view of the state that the cartridge for tunnel blasting in accordance with an example embodiment further includes a wedge device, and FIG. 5 is a conceptual view of the state that the cartridge for tunnel blasting in accordance with an example embodiment includes a stirrer.

Example embodiments relate to a cartridge for tunnel blasting.

In accordance with example embodiments, as illustrated in FIG. 1, a bore hole 410 is formed in a rock 400, and a cartridge containing water is injected into the bore hole 410. Thereafter, a sponge 405 containing water therein is inserted between the cartridge 100 and the bore hole 410 to fill in irregular portions of the bore hole 410, and liquid nitrogen is injected into the cartridge 100, such that the water contained in the cartridge 100 and the water contained in the sponge 405 are rapidly frozen.

Here, the cartridge 100 includes an inner tube 120 containing water therein, an outer tube 130, which is provided on an external side of the inner tube 120, a cap 110, which seals ends of the inner tube 120 and the outer tube 130, and a nitrogen injection line 112 and a nitrogen discharge line 114, which are provided in the cap 110.

In this case, the inner tube 120 and the outer tube 130 are formed in a cylindrical shape, one side ends of the tubes in the longitudinal direction may be formed to be open, and the other side ends thereof may be formed to be sealed. In addition, the ends formed to be open are provided with the cap 110 so as to be sealable.

The method for sealing the ends formed to be open by means of the cap 110 may be one of various methods such as welding or screw coupling.

In addition, the nitrogen injection line 112 provided in the cap 110 is formed to penetrate through the cap 110, such that liquid nitrogen can be injected into the space between the inner tube 120 and the outer tube 130. In addition, the nitrogen discharge line 114 provided in the cap 110 is formed to penetrate through the cap 110, such that nitrogen injected into the space between the inner tube 120 and the outer tube 130 can be discharged outward.

In addition, when the nitrogen injection line 112 injects relatively low pressure liquid nitrogen, a separate vacuum pump (not illustrated) may be initially connected to the nitrogen discharge line 114, and thereby, facilitating the injection of the liquid nitrogen.

When liquid nitrogen is injected through the nitrogen injection line 112 of the cap 110 by using an injection device 320, the liquid nitrogen is injected into the space formed between the inner tube 120 and the outer tube 130, water contained in the inner tube 120 and water contained in the sponge 405 located on the external side of the outer tube 13 are rapidly frozen, and the bore hole 410 formed on the rock 400 is pressurized by the volume increasing as the water is frozen, so that cracks occur in the bore hole 410, and the rock 400 can be easily broken.

In this course, if the bore hole 410 is sealed by using [[a]]the sponge 405, both the inner tube 120 and the outer tube 130 may be formed of a metal material having high heat conductivity.

In addition, if the sponge 405 is not used, the inner tube 120 may be formed of a metal material having high heat conductivity, and the outer tube 130 may be formed of a synthetic resin or a rubber material having high thermal insulation to prevent the chill of the liquid nitrogen from being discharged outward, so that heat efficiency can be improved.

In addition, by injecting sand, the sponge 405 or others into the bore hole 410 formed on the rock 100 to fill in the space between the cartridge 100 and the bore hole 410, the expansion force is stably transferred, so that cracks can more easily occur in the rock 100.

In addition, water may be injected in advance into the inner tube 120, or directly injected by forming a water injection line (not illustrated) and a foam discharge line (not illustrated) to be connected to the inner tube 120.

Meanwhile, with respect to another example embodiment, as illustrated in FIG. 2, pin members 122 may be provided with certain intervals on the outer circumference surface of the inner tube 120 forming the cartridge 100. The pin members 122 may be formed of various metal materials, but for example, by mostly using dural minyum (duralumin) that is light and has high strength.

Accordingly, when the water contained in the inner tube 120 is frozen and expands due to the liquid nitrogen injected through the nitrogen injection tube 112, the expansion force may be more quickly transferred to the inner circumference surface of the bore hole 410, so that cracks can more easily occur.

In addition, as illustrated in FIG. 3, the pin members 122 may be connected to one another by a separate connector 124. Accordingly, the pin members 122 can be more easily provided on the outer circumference surface of the inner tube 120.

In addition, with respect to another example embodiment, as illustrated in FIG. 4, the wedge device 200 is inserted into the bore hole 410 formed on the rock 400, and the cartridge 100 may be provided in the internal side of the wedge device 200.

The wedge device 200 may include a first operating bar 210 and a second operating bar 220, which are in a rod shape, and an arc-shaped guide bar 240 that guides movement of the first and second operating bars 210, 220. In addition, one side ends (the portion toward the 3 o'clock direction with reference to FIG. 4) of the first and second operating bars 210, 220 may be coupled to each other by a hinge, and the cartridge 100 may be positioned between the first and second operating bars 210, 220.

In addition, the other sides of the first and second operating bars 210, 220 (the portion generally toward the 9 o'clock with reference to FIG. 4) may be inserted into a guide hole 242, which is formed on both sides of the guide bar 240 and in a long hole shape. Accordingly, the first and second operating bars 210, 220 may spin based on the hinge-coupled portion along the guide hole 242.

That is, liquid nitrogen is supplied to the cartridge 100 positioned between the first and second operating bars 210, 220, such that when water in the cartridge is rapidly frozen, the volume of the water increases, and accordingly, the first and second operating bars 210, 220 spin outwardly based on the hinge-coupled portion, and since the first and second operating bars 210, 220 spin by the guide hole 242 of the guide bar 240 along the guide hole 242, the whole inner circumference surface of the bore hole 410 is pressurized, so that the bore hole 410 can be stably broken.

Meanwhile, a pressurizing member 244 that pressurizes the end of the cartridge 100 may be provided in the internal side of the guide bar 240. In other words, the pressurizing member 244 that pressurizes the cartridge 100 may be provided between the guide bar 240 and the cartridge 100.

In addition, fixing members 230 that prevent deviation of the guide bar 240 may be provided in the first and second operating bars 210, 220. For example, screw-shaped fixing members 230 may be provided in the other sides of the first and second operating bars 210, 220, respectively. More specifically, as illustrated in FIG. 4, the fixing members 230 may be provided on the other side surface (the surface generally toward the 9 o'clock direction with reference to FIG. 4) of the guide bar 240. Such fixing members 230 may pressurize the guide bar 240 that guides the first and second operating bars 210, 220 toward one side. Accordingly, since the pressurizing member 244 pressurizes the cap 110 provided in the end portion of the cartridge 100, the cap 110 can be prevented from being moved toward the other side of the cartridge even when the water in the cartridge is frozen and expands by the liquid nitrogen, and as a result, the water expands only toward the side portion, so that cracks can more easily occur in the bore hole 410.

In addition, since the other components are the same as described above, separate descriptions thereof are omitted.

Meanwhile, with respect to another example embodiment, as illustrated in FIG. 5, the cartridge 100 inserted into the bore hole 410 formed on the rock 400 may include the inner tube 120 containing water, the outer tube 130, which is provided on the external side of the inner tube 120, and the cap 110, which seals the ends of the inner tube 120 and the outer tube 130.

In addition, a stirrer 140 may be provided in the internal side of the cap 110 to be positioned in the inside of the inner tube 120.

In addition, a motor 145 may be provided on the external side of the cap 110. A spin axis of the motor 145 may be connected with the stirrer 140. Accordingly, the stirrer 140 can spin by the motor 145.

Since the water contained in the inner tube 120 is convected, a chill to be transferred from the outside is evenly spread within the water, so that the water can be more quickly frozen.

In addition, since the other components are the same as described above, separate descriptions thereof are omitted.

Meanwhile, as illustrated in FIG. 1 and FIG. 4, an irradiation device 310 may be provided on the external side of the cartridge 100. The irradiation device 310 irradiates an ultrasonic wave or microwave having a certain frequency to the cartridge 100, to excitate the water contained in the cartridge 100 and facilitate transfer of heat energy.

Accordingly, the chill of the liquid nitrogen to be injected into the cartridge 100 is more quickly transferred to the whole water contained in the inner tube 120, so that the contained water can be more quickly frozen.

In addition, the irradiation device 310 may include a sensor (not illustrated). Example embodiments can exactly determine a degree of freezing of the water contained in the cartridge 100 inserted into the bore hole 410 of the rock 400, in the manner that the sensor senses reflection of an ultrasonic wave irradiated by the irradiation device 310.

Accordingly, if the stirrer 140 is provided in the cartridge 100, when an ice thickness is close to the position of the stirrer 140, the operation of the stirrer 140 can be stopped, and accordingly, destroy of the motor 145 can be prevented.

Meanwhile, the sensor may be integrated with the irradiation device 310. Or, the sensor may be provided as a separate device, to be positioned in the direction irradiating an ultrasonic wave in the irradiation device 310, such that it can sense the irradiated ultrasonic wave and determine a degree of the freezing of the water.

In addition, a multiple number of bore holes 410 may be formed on one rock 400, and the cartridge 100 may be inserted into each of the bore holes 410. Thereafter, by controlling time for injecting liquid nitrogen into the cartridge 100, the cartridge 100 may be frozen step by step according to the state of the rock 400. Or, the cartridge 100 may be simultaneously frozen by simultaneously injecting liquid nitrogen, Since the other components are the same as described above, separate descriptions thereof are omitted.

The present disclosure has been described with reference to preferable examples. However, it would be understood by those skilled in the art that the protection scope of the present disclosure is not limited to the foregoing examples, and that various changes and modifications to the present disclosure can be made without departing from the technical concept and area of the present disclosure.

INDUSTRIAL APPLICABILITY

Example embodiments described herein pertain to a cartridge for tunnel blasting, in particular, a cartridge for tunnel blasting, which injects a cartridge containing water into a bore hole to be formed in a rock, and rapidly cooling the water injected into the cartridge, whereby the rock can be easily broken by using the characteristic of water that expands when it is frozen.

EXPLANATION OF CODES

100: Cartridge
110: Cap
112: Nitrogen injection line
114: Nitrogen discharge line
120: Inner tube
122: Pin members
124: Connection member
130: Outer tube
140: Stirrer
145: Motor
200: Wedge device
210: First operating bar
220: Second operating bar
230: Fixing member
240: Guide bar
242: Guide hole
244: Pressurizing member
310: Irradiation device
320: Injection device
400: Rock
410: Bore hole

I claim:

1. A cartridge for tunnel blasting, which is inserted into a bore hole formed in a rock, comprising:

an inner tube containing water;

an outer tube provided on an external side of the inner tube;

a cap sealing ends of the inner and outer tubes;

a nitrogen injection line provided to penetrate through the cap and inject liquid nitrogen which can freeze the water into a space formed between the inner and outer tubes; and a nitrogen discharge line provided to penetrate through the cap and discharge nitrogen in the space formed between the inner and outer tubes.

2. The cartridge for tunnel blasting of claim 1, wherein the cartridge further comprises pin members provided on an outer circumference surface of the inner tube with certain intervals.

3. The cartridge for tunnel blasting of claim 1, wherein the cartridge further comprises a stirrer provided in the internal side of the cap to be positioned in the inside of the inner tube and a motor provided on an external side of the cap to spin the stirrer.

4. A tunnel blasting system, comprising a wedge device inserted into a bore hole formed in a rock; and a cartridge for tunnel blasting, which is provided in an internal side of the wedge device, wherein the cartridge comprises :

an inner tube containing water;

an outer tube provided on an external side of the inner tube;

a cap sealing ends of the inner and outer tubes;

a nitrogen injection line provided to penetrate through the cap and inject liquid nitrogen which can freeze the water into a space formed between the inner and outer tubes; and a nitrogen discharge line provided to penetrate through the cap and discharge nitrogen in the space formed between the inner and outer tubes.

5. The tunnel blasting system of claim 4, wherein the wedge device comprises first and second operating bars, and a guide bar, of which both sides are provided with a guide hole, wherein an end of the first operating bar and an end of the second operating bar are coupled to each other by a hinge, and the other ends of the first and second operating bars are inserted into the guide hole.

6. The tunnel blasting system of claim 5, wherein the first and second operating bars are provided with a fixing member that prevents deviation of the guide bar.

7. The tunnel blasting system of claim 4, further comprising a sponge, which contains water and can be provided in an external side of the cartridge.

* * * * *